US011647849B2

(12) United States Patent
Horvath et al.

(10) Patent No.: US 11,647,849 B2
(45) Date of Patent: May 16, 2023

(54) SECURITY GATE

(71) Applicant: SENNCO SOLUTIONS, INC., Plainfield, IL (US)

(72) Inventors: Daniel L. Horvath, Plainfield, IL (US); Christopher Alan Marszalek, Plainfield, IL (US); Dale R. Liff, Montgomery, IL (US); George R. Liff, Streetsboro, OH (US)

(73) Assignee: SENNCO SOLUTIONS, INC., Plainfield, IL (US)

( * ) Notice: Subject to any disclaimer, the term of this patent is extended or adjusted under 35 U.S.C. 154(b) by 310 days.

(21) Appl. No.: 17/068,501

(22) Filed: Oct. 12, 2020

(65) Prior Publication Data

US 2021/0106148 A1 Apr. 15, 2021

Related U.S. Application Data

(60) Provisional application No. 62/914,147, filed on Oct. 11, 2019, provisional application No. 62/915,441, filed on Oct. 15, 2019.

(51) Int. Cl.

| | |
|---|---|
| ***G08B 13/08*** | (2006.01) |
| ***G08B 13/06*** | (2006.01) |
| ***A47F 3/00*** | (2006.01) |
| ***A47F 5/00*** | (2006.01) |
| ***G08B 7/06*** | (2006.01) |

(52) U.S. Cl.

CPC ..... *A47F 3/002* (2013.01); *A47F 5/0018* (2013.01); *G08B 7/06* (2013.01); *G08B 13/06* (2013.01); *G08B 13/08* (2013.01)

(58) Field of Classification Search

CPC ..... G08B 7/06; G08B 13/06; G08B 13/08; A47F 3/002; A47F 5/0018

See application file for complete search history.

(56) References Cited

U.S. PATENT DOCUMENTS

| | | | | |
|---|---|---|---|---|
| 1,615,120 A | | 1/1927 | Fischer | |
| 3,749,279 A | * | 7/1973 | Ungerman | G07F 5/18 221/7 |
| 4,130,326 A | | 12/1978 | Hornblad | |

(Continued)

FOREIGN PATENT DOCUMENTS

| | | |
|---|---|---|
| EP | 1777665 A1 | 4/2007 |
| FR | 2541102 A1 | 8/1984 |

OTHER PUBLICATIONS

U.S. Patent Office, English language version of the International Search Report, Form PCT/ISA/210 for International Application PCT/US2020/055282, dated Mar. 1, 2021 (2 pages).

(Continued)

*Primary Examiner* — Hoi C Lau

(74) *Attorney, Agent, or Firm* — Pauley Erickson & Swanson

(57) ABSTRACT

A security gate for a retail store shelf having one or more products includes a header and at least one hinge arranged in a horizontal alignment with the header. A rigid frame is connected to the header with the at least one hinge and a guard is positioned across the rigid frame, the guard preventing a user from removing the products. A latching mechanism connects the rigid frame to the header and urges a customer to use two hands to open the security gate.

19 Claims, 11 Drawing Sheets

(56) References Cited

U.S. PATENT DOCUMENTS

| | | | | |
|---|---|---|---|---|
| 4,506,776 | A * | 3/1985 | Voegeli | G07F 11/045 194/350 |
| 5,248,060 | A * | 9/1993 | Friedman | G07F 11/045 221/241 |
| 5,392,025 | A | 2/1995 | Figh et al. | |
| 6,216,391 | B1 * | 4/2001 | Garrett, Jr. | E05B 53/003 49/141 |
| 6,279,684 | B1 * | 8/2001 | Lewis | G07F 11/045 186/36 |
| 7,299,934 | B2 * | 11/2007 | Hardy | A47F 1/125 211/189 |
| 2013/0193823 | A1 * | 8/2013 | Cho | D06F 39/14 312/319.2 |
| 2015/0191955 | A1 * | 7/2015 | Dudley | E05F 3/08 49/386 |
| 2016/0240032 | A1 * | 8/2016 | Agor | G07F 11/62 |
| 2017/0140600 | A1 * | 5/2017 | Halsey, Jr. | G06K 19/077 |
| 2017/0284136 | A1 * | 10/2017 | Ramsey | E06B 11/022 |
| 2017/0301198 | A1 * | 10/2017 | Grant | G08B 21/0225 |
| 2021/0106148 | A1 * | 4/2021 | Horvath | G08B 13/06 |
| 2021/0375106 | A1 * | 12/2021 | Marszalek | A47F 3/002 |

OTHER PUBLICATIONS

U.S. Patent Office, English language version of the Written Opinion of the ISA, Form PCT/ISA/237 for International Application PCT/US2020/055282, dated Mar. 1, 2021 (9 pages).

* cited by examiner

SECURITY GATE

CROSS REFERENCE TO RELATED APPLICATIONS

This application claims the benefit of U.S. Provisional Patent Application, Ser. No. 62/914,147, filed on 11 Oct. 2019 and U.S. Provisional Patent Application, Ser. No. 62/915,441, filed on 15 Oct. 2019. These Provisional Applications are hereby incorporated by reference herein in their entirety and are made a part hereof, including but not limited to those portions which specifically appear hereinafter.

BACKGROUND OF THE INVENTION

Field of the Invention

The invention is related to security gate for deterring theft of retail inventory.

Description of the Prior Art

A growing problem for retail stores is theft of high value inventory directly from shelves. Thieves target retail stores to "sweep" shelves of valuable product by quickly assembling and removing as much of the product as possible, then exit the store with the product before store personnel or law enforcement have an opportunity to react. The product is either later returned for cash or sold outright.

Solutions to this problem have included locking down high value product in vaults or cabinets that require store personnel to unlock and physically provide the product to the customer. Other solutions include security wires that physically connect the product to store shelves or each other. Again, these solutions require store personnel to unlock and untether such product for the consumer. These solutions tend to discourage customers from purchases.

Still other solutions utilize mechanical dispensers connected to shelves that are configured to mechanically dispense one product at a time before resetting for dispensing another product. These solutions are not flexible for a variety of inventory and inflexibly require particular store shelves to be dedicated to particular inventory.

A need therefore exists to slow such thieves down, maintain inventory and alert store staff regarding interest while also enabling shoppers to examine and purchase product unencumbered by lock and key solutions.

SUMMARY OF THE INVENTION

A security gate according to one embodiment of this invention includes: a latching mechanism, a rigid frame, one or more horizontal hinges, a grate comprising a network of bars or wires sized appropriately to the product on the shelves, and a mounting receiver for mounting to the existing store shelves.

The security gate according to one embodiment of this invention is designed to be used as an anti-sweep theft deterrent by blocking the consumer inventory when closed, but causing the customer to do a deliberate act of opening the security gate and holding it open with one hand, while retrieving the inventory with the other, thus making it difficult to remove many products quickly and easily. A visible flashing or strobe light and/or an audible chime and/or other signaling method is preferably also triggered when the security gate is open, alerting the employees of activity in that department.

DETAILED DESCRIPTION

Figure 1:
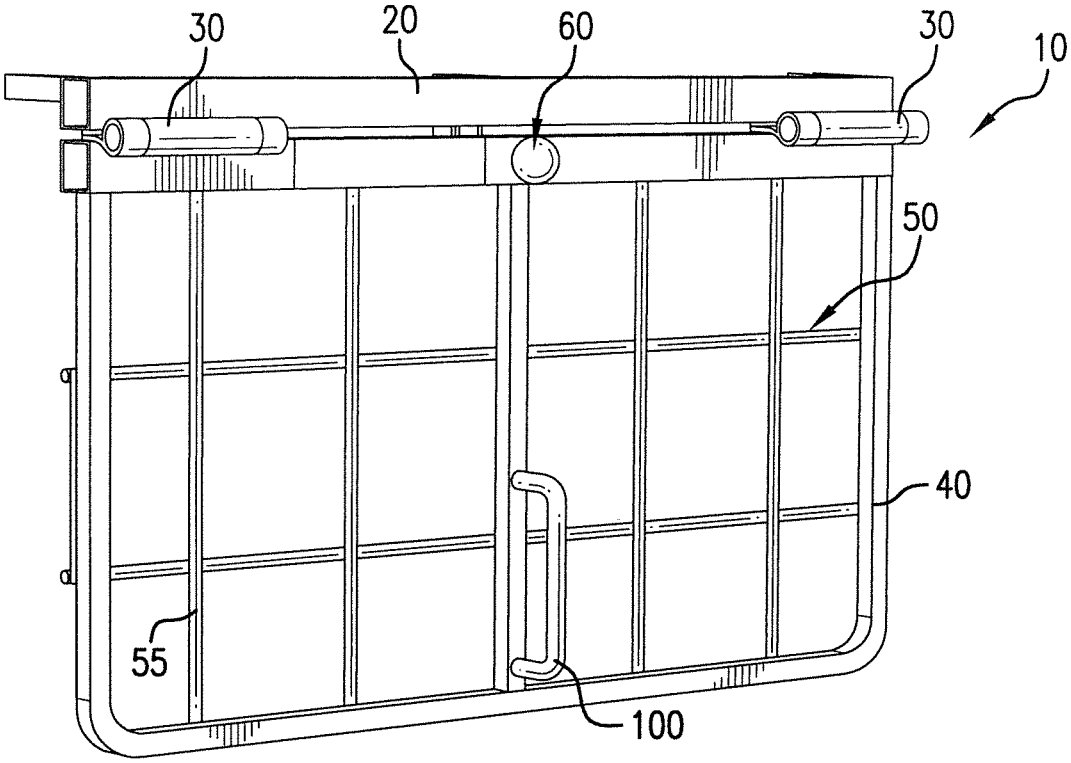
FIG. 1 is a front perspective view of a security gate in a closed position in accordance with one aspect of the subject invention.

A security gate according to a preferred embodiment of the invention is installed onto the leading edge of a shelf or racking typically used in retail environments for holding and displaying consumer products. The security gate preferably covers and blocks one or more products or blocks of products on a shelf or shelving unit.

The products as described are typically high value, high demand products that are easily accumulated and removed if unimpeded. A demand exists to slow the practice of "sweeping" such products from the shelves and quickly exiting a retail store whereupon such products may be resold or returned back to the very store from where they were stolen for a refund or store credit. The term sweeping comes from a sweeping motion of a hand or arm of a thief across a shelf as they quickly dispatch multiple products from a shelf into a cart or other conveyance. Examples of such products which would benefit from such security gates includes power tools, over-the-counter pharmaceuticals, electronic devices, liquor, and other such products although the subject apparatus and system could be used in connection with virtually any product that is displayed for retail purchase.

Mounting methods can vary depending on what type of shelving or racking is used. Remaining components of the security gate are preferably generally uniform across all various mounting receivers. A main swing gate attachable to the mounting receiver is designed to be attached and removed from the receiver for easier installation and scalable flexibility.

As shown in FIGS. 1-20, a security gate 10 according to one embodiment of this invention includes a header 20, at least one hinge 30, a rigid frame 40, and a guard 50. The subject elements are described in more detail below.

As best shown in FIGS. 13-17, a header 20 is preferably mounted to the shelf to provide a support for the remainder of the security gate 10. A mounting receiver 15 in accordance with one aspect of the invention may be fitted with two or more hitch receivers 18 that engage with corresponding forks 24 in the header 20 and/or a rigid frame 40 described below. The header 20 is preferably mounted relative to the mounting receiver 15 that is fixed relative to a store shelving unit. As such, both the header 20 and the mounting receiver 15 are preferably fixed and immovable relative 10 tie shelf. The mounting receiver 15 and/or the header 20 may extend across the entirety of a shelf or for a portion of the shelf depending on the application.

Moving or removing the security gate 10 may be done by loosening pinch bolts and sliding the header 20 out of the mounting receiver 15. The entire remaining security gate 10 assembly can then be walked over to a new section of the fixture and slid into a different mounting receiver 15. Tightening the pinch bolts secures the security gate 10 in place again. Extra mounting receivers 15 can be pre-mounted in the fixture to allow for quick and flexible security gate layouts. Components of the security gate 10 can be customized in different sizes depending on the need. According to one embodiment, the security gate is available in two standard sizes, 22" wide×10.5" tall, and 22" wide×13.5" tall, respectively.

Figure 2:
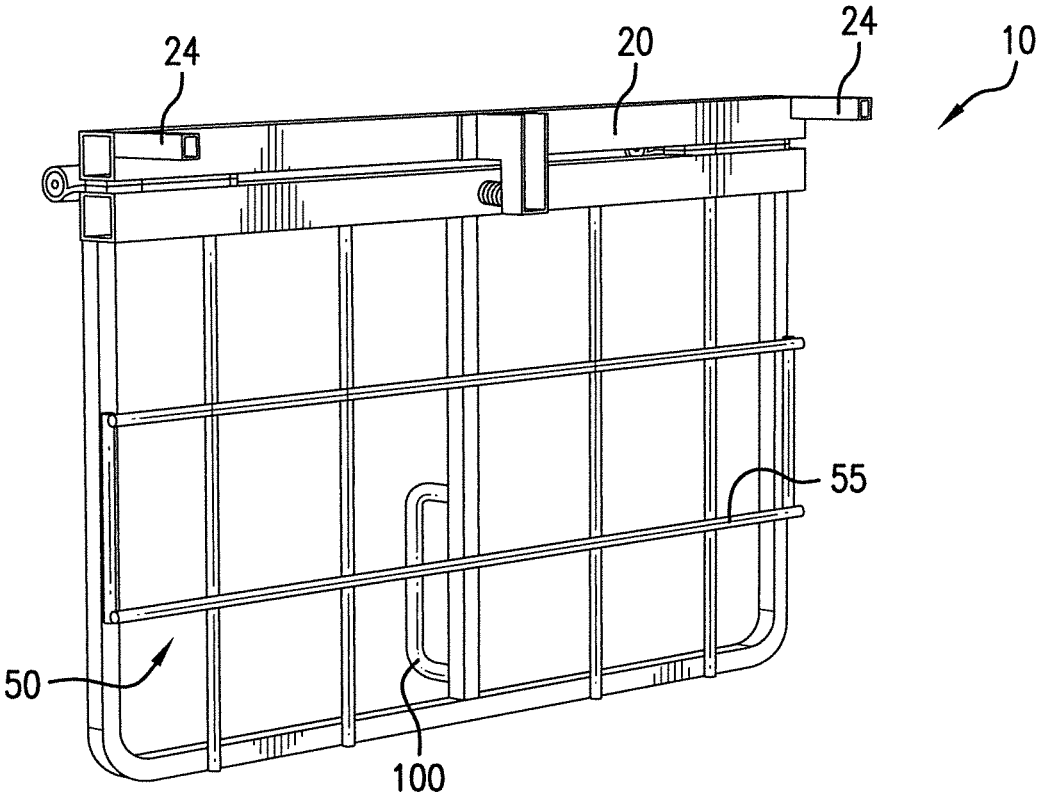
FIG. 2 is a rear perspective view of the security gate shown in FIG. 1.
Figure 3:
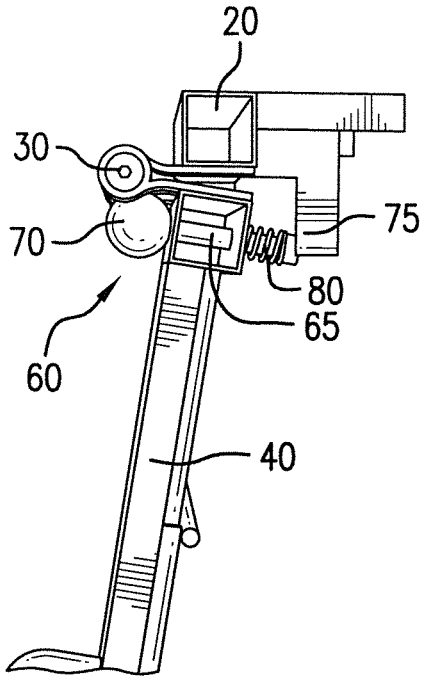
FIG. 3 is a side view of a latching mechanism of the security gate shown in FIG. 1.
Figure 4:
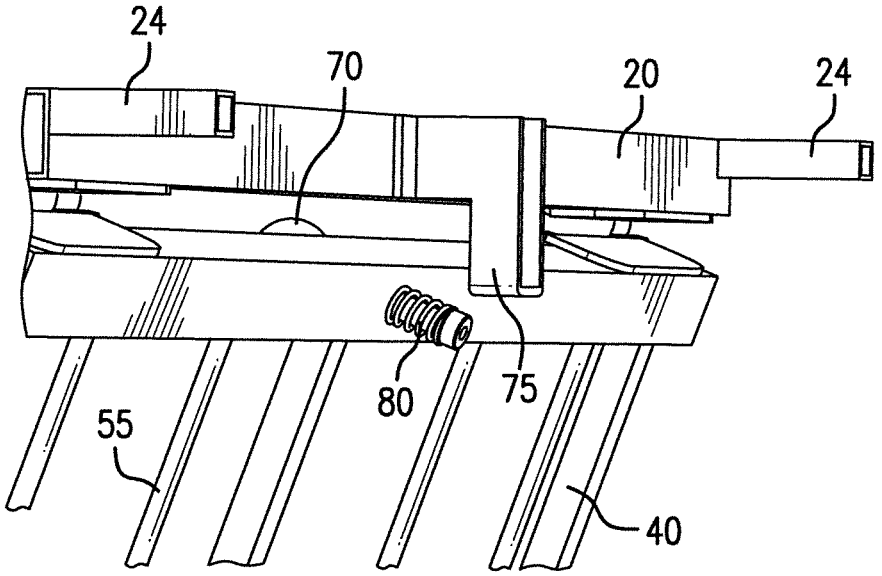
FIG. 4 is a rear perspective view of the latching mechanism shown in FIG. 3.

As shown in FIGS. 1-2, a header 20 is positioned along a shelf and includes at least one hinge 30 arranged in a horizontal alignment with the header 20. The hinge 30 may extend along an entire length of the header 20 or may comprise two or more hinges 30 placed at intervals along the header 20, such as shown in the figures. The hinge 30 may be positioned such that ii faces inwardly and is not accessible from outside the security gate 10 or may be positioned outwardly to more easily promote an upward swing of operable components of the security gate 10, such as show in FIGS. 1-5.

A rigid frame 40 is preferably connected to the header 20 with the at least one hinge 30. The rigid frame 40 thereby is positioned and configured to swing upwardly relative to the header 20 along the hinge or hinges 30. The rigid frame 40 is preferably constructed of a rigid material that maintains a rugged and unbreakable framework along a front of the shelf. In particular, the security gate 10 preferably includes a rigid frame 40 constructed of metal or similar material that is secure and will resist cutting, bending or similar destructive actions.

The rigid frame 40 may span an entirety of the height and width of the shelf or may be strategically sized to span only a portion of the shelf depending on the product to be secured. In fact, it may be possible with a larger product, to include a rigid frame 40 that only spans half or less of the height of the shelf, thereby allowing more unfettered inspection of the product by the customer but still preventing removal from the shelf without opening the security gate 10.

Figure 5:
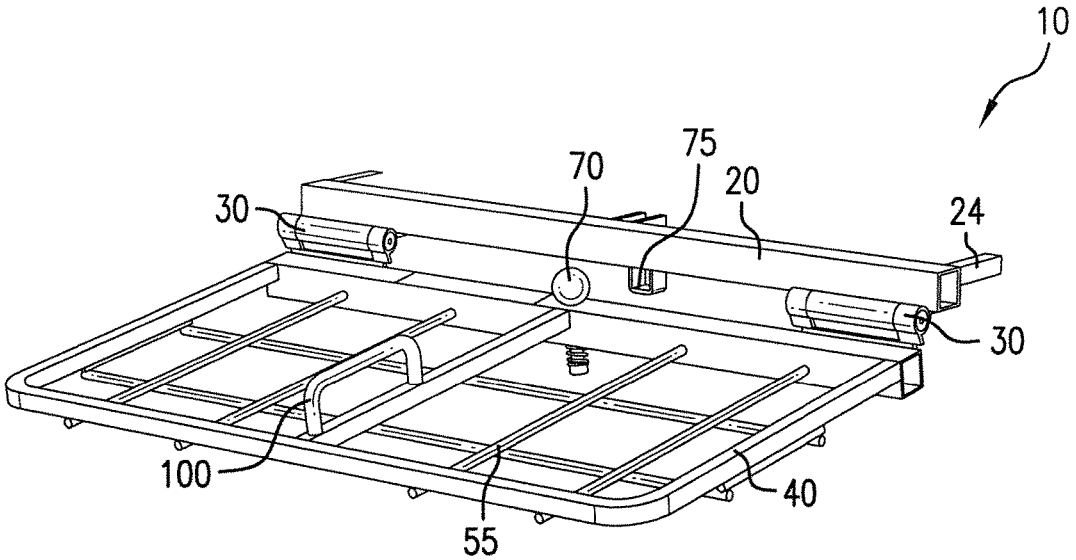
FIG. 5 is a front perspective view of the security gate shown in FIG. 1 in an open position.
Figure 6:
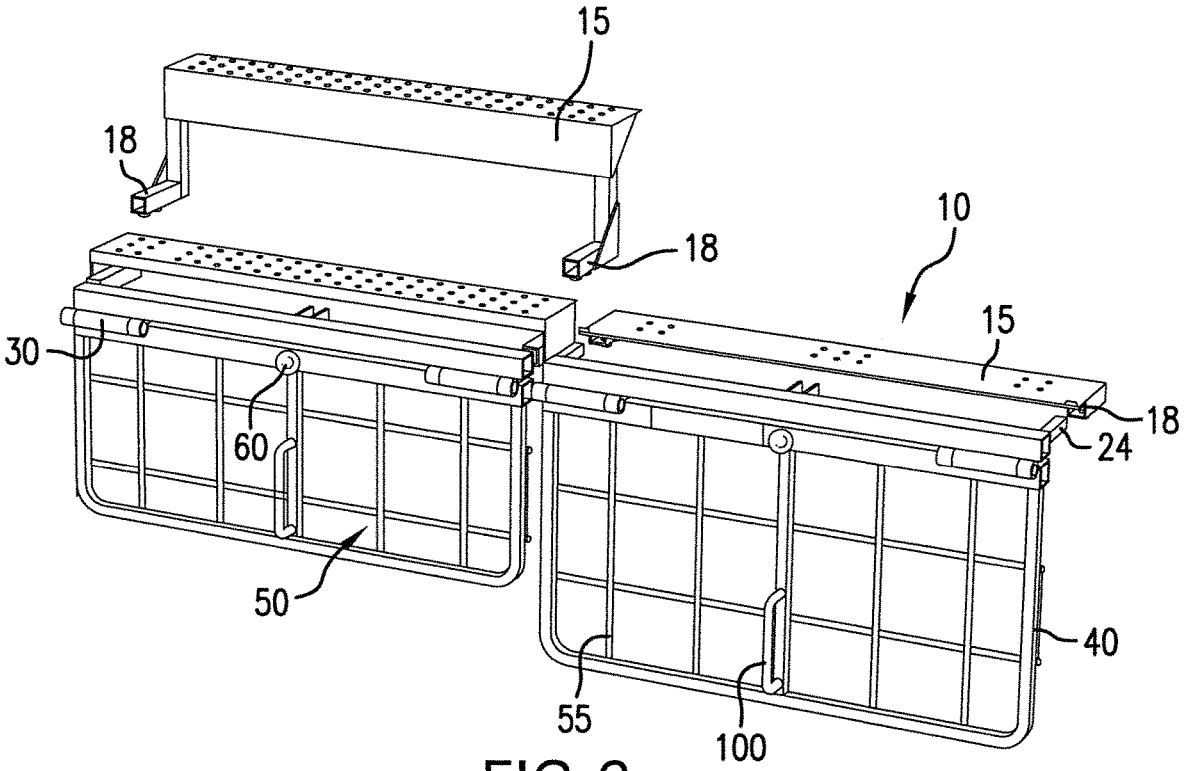
FIG. 6 is a front perspective view of an assembly of security gates in accordance with one aspect of the subject invention.
Figure 7:
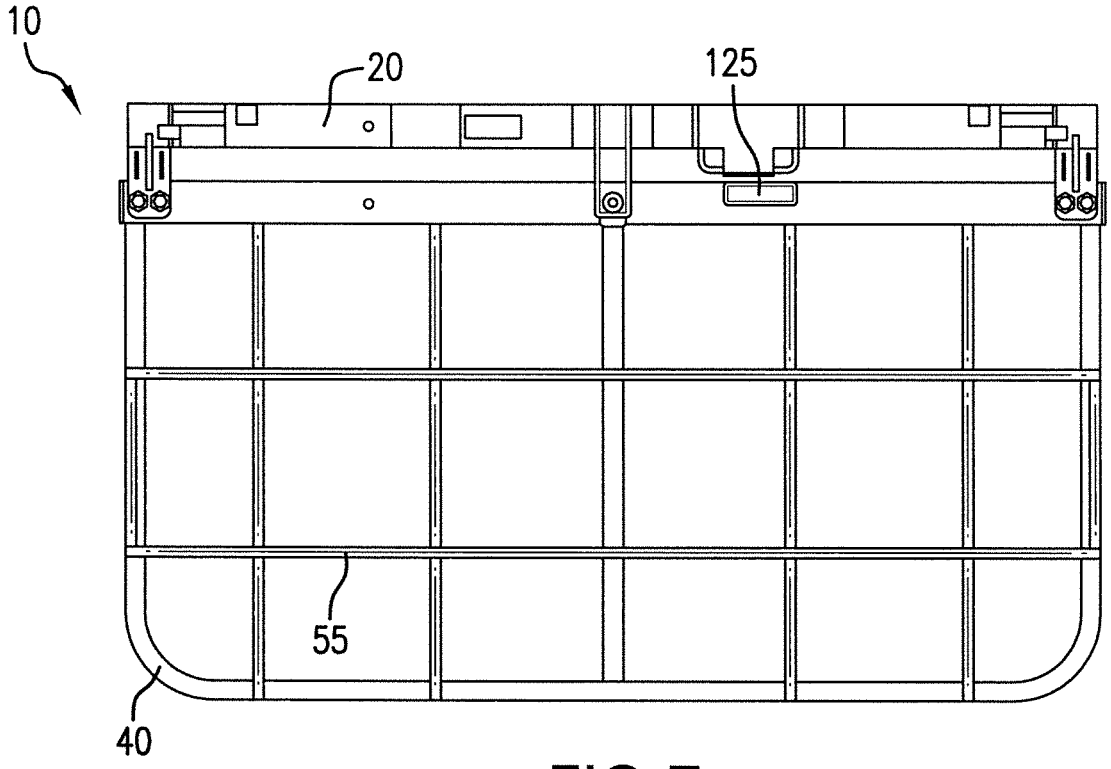
FIG. 7 is a rear view of the security gale shown in FIG. 1.
Figure 8:
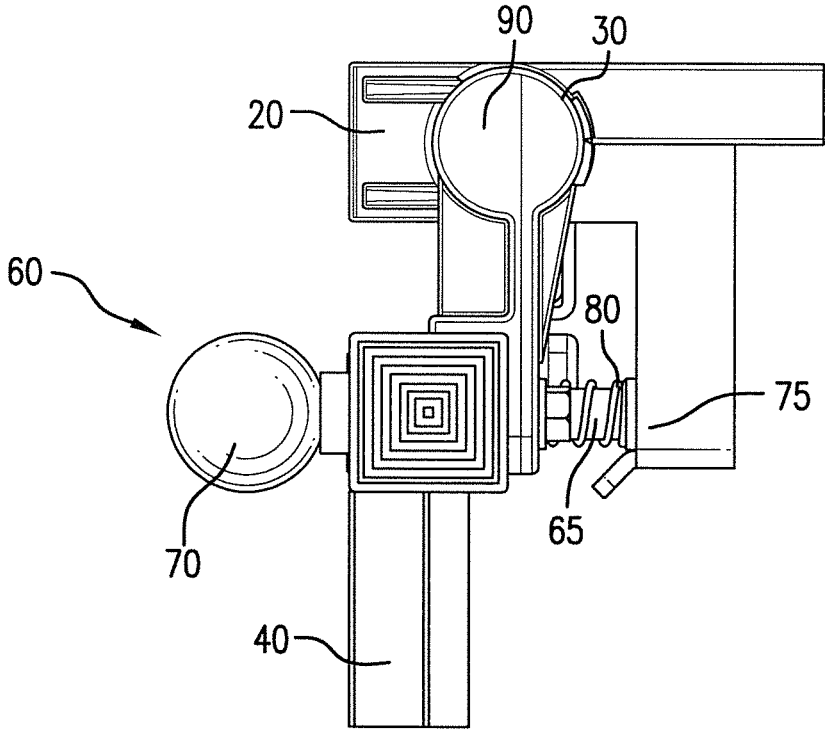
FIG. 8 is a side close-up view of a latching mechanism.
Figure 9:
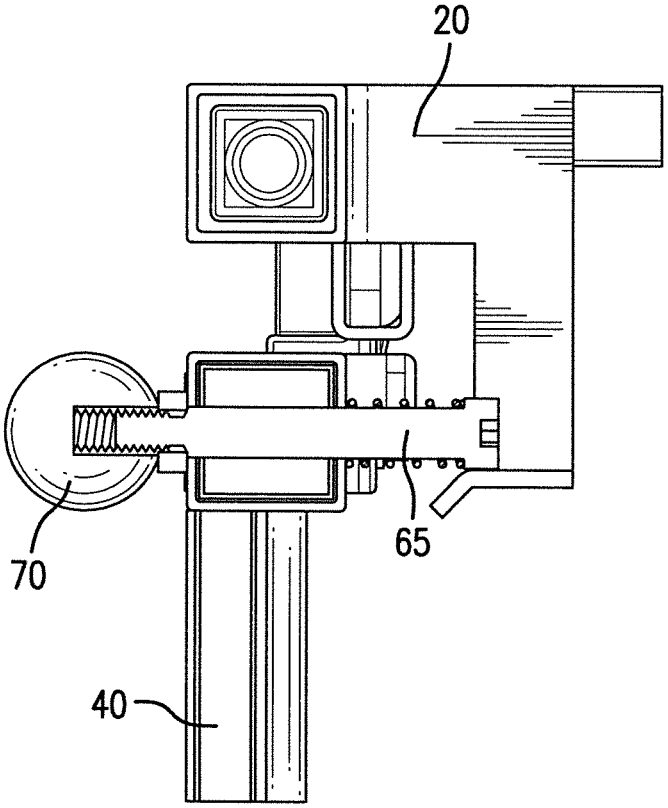
FIG. 9 is a side cutaway view of the latching mechanism shown in FIG. 8.
Figure 10:
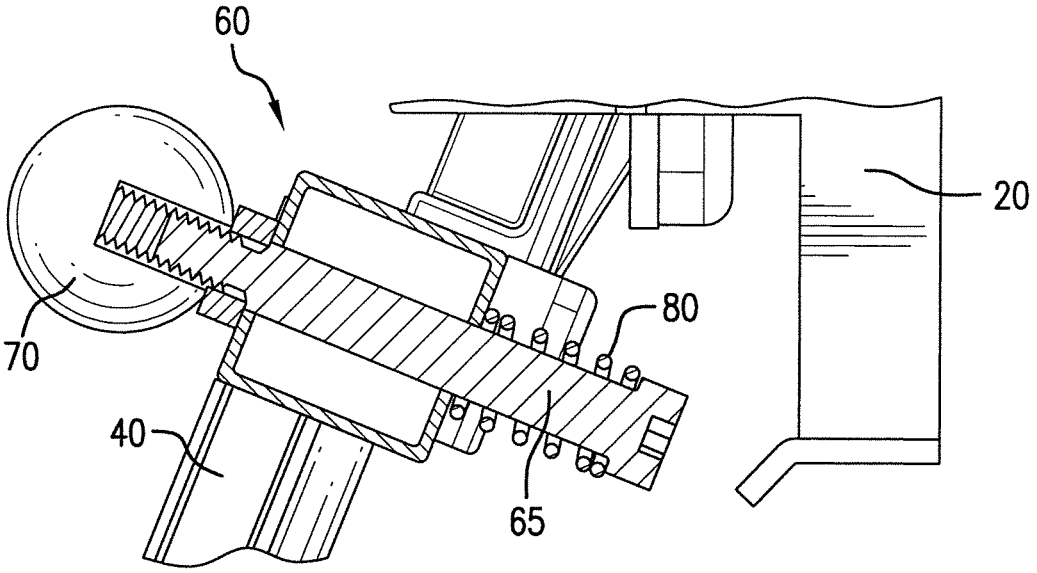
FIG. 10 is a side close-up view of a latching mechanism in a partially open position.
Figure 11:
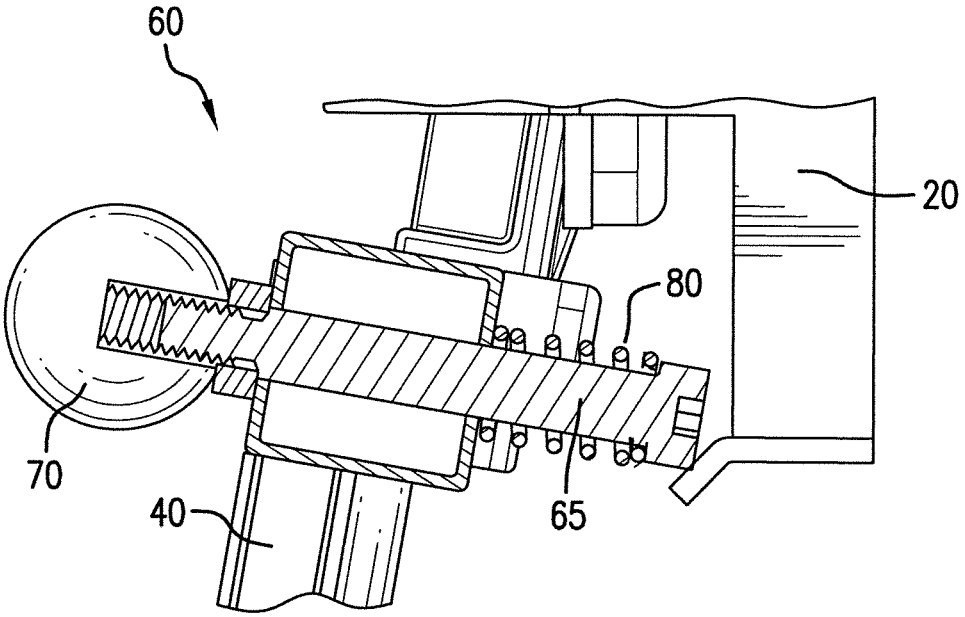
FIG. 11 is a side close-up view of the latching mechanism shown in FIG. 10 in a partially closed position.
Figure 12:
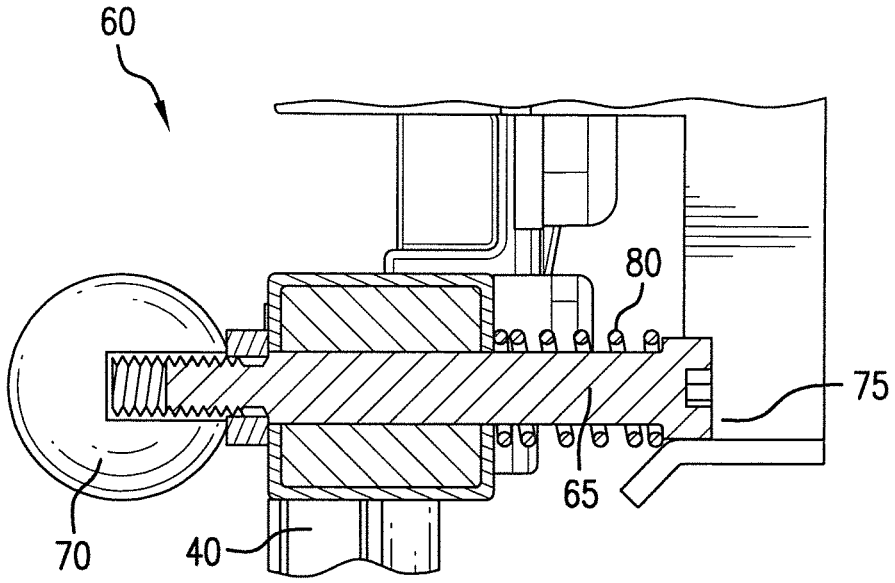
FIG. 12 is a side close-up view of the latching mechanism shown in FIG. 10 in a closed position.
Figure 13:
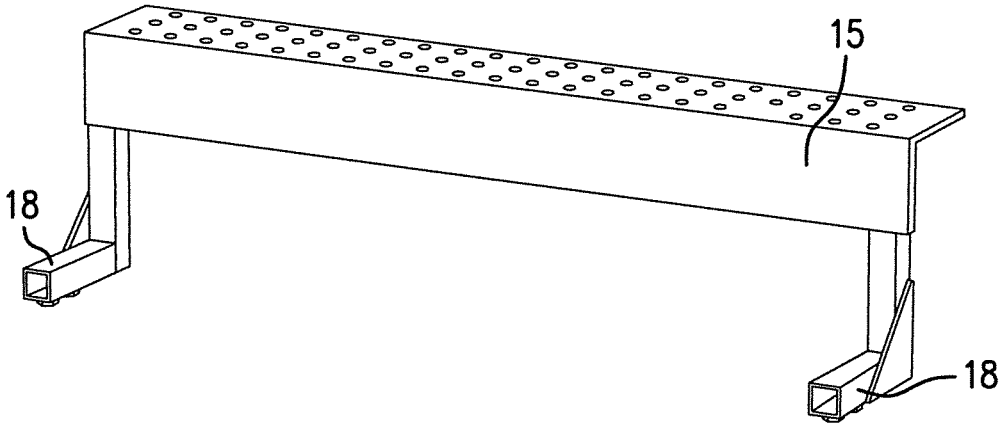
FIG. 13 is a perspective view of a mounting receiver in accordance with one aspect of the subject invention.
Figure 14:
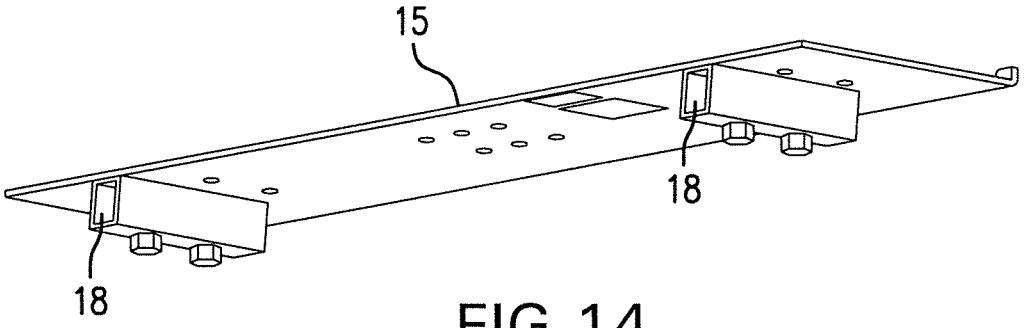
FIG. 14 is a perspective view of a mounting receiver in accordance with one aspect of the subject invention.
Figure 15:
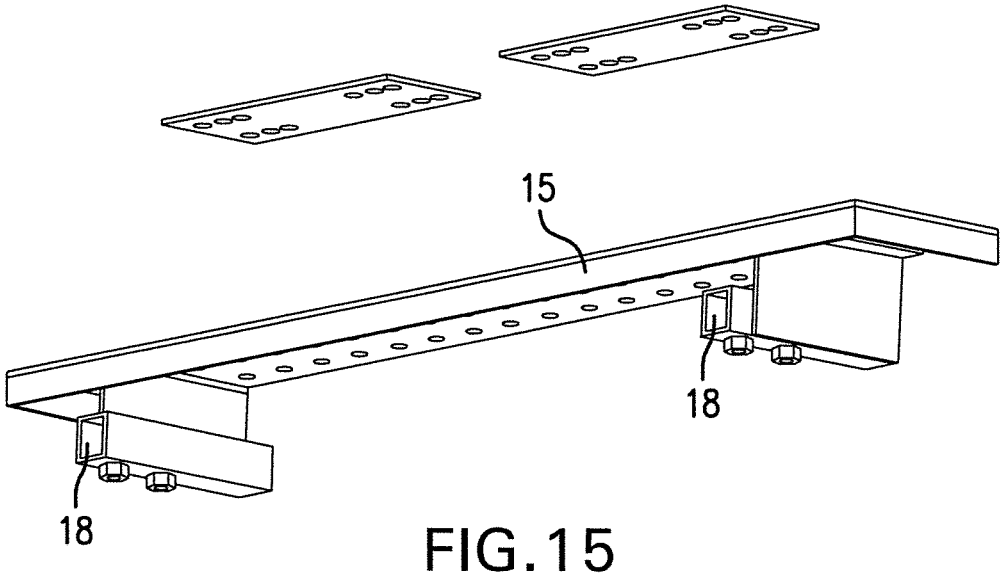
FIG. 15 is a perspective view of a mounting receiver in accordance with one aspect of the subject invention.
Figure 16:
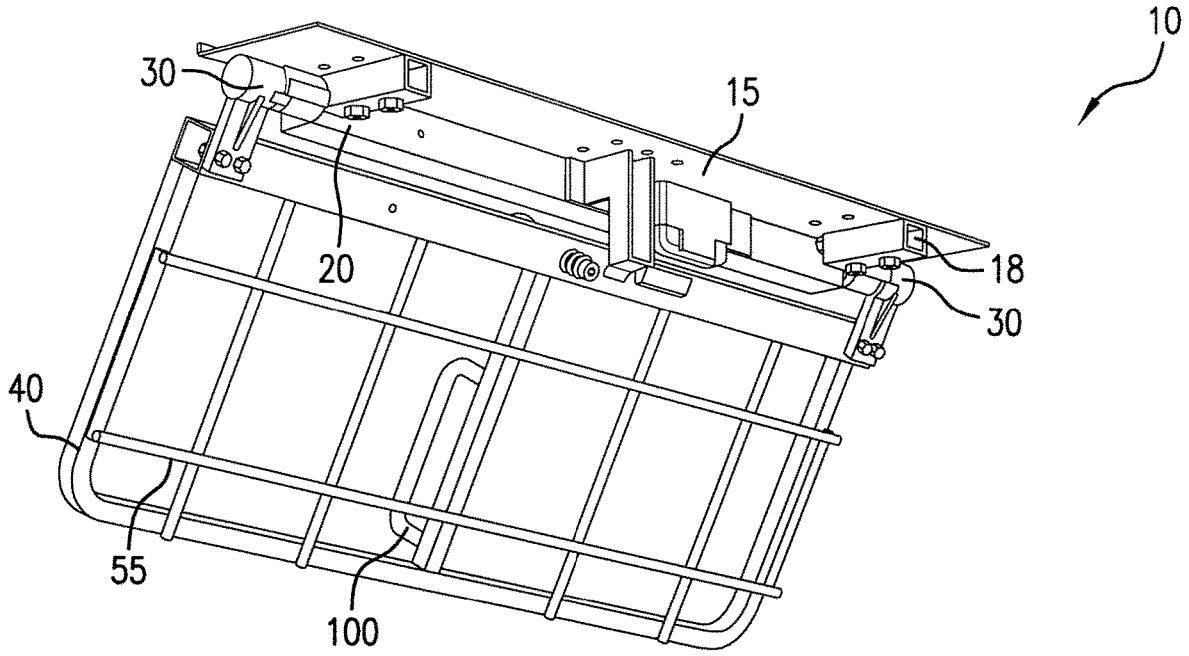
FIG. 16 is a rear perspective view of a mounting receiver and security gate in accordance with one aspect of the subject invention.
Figure 17:
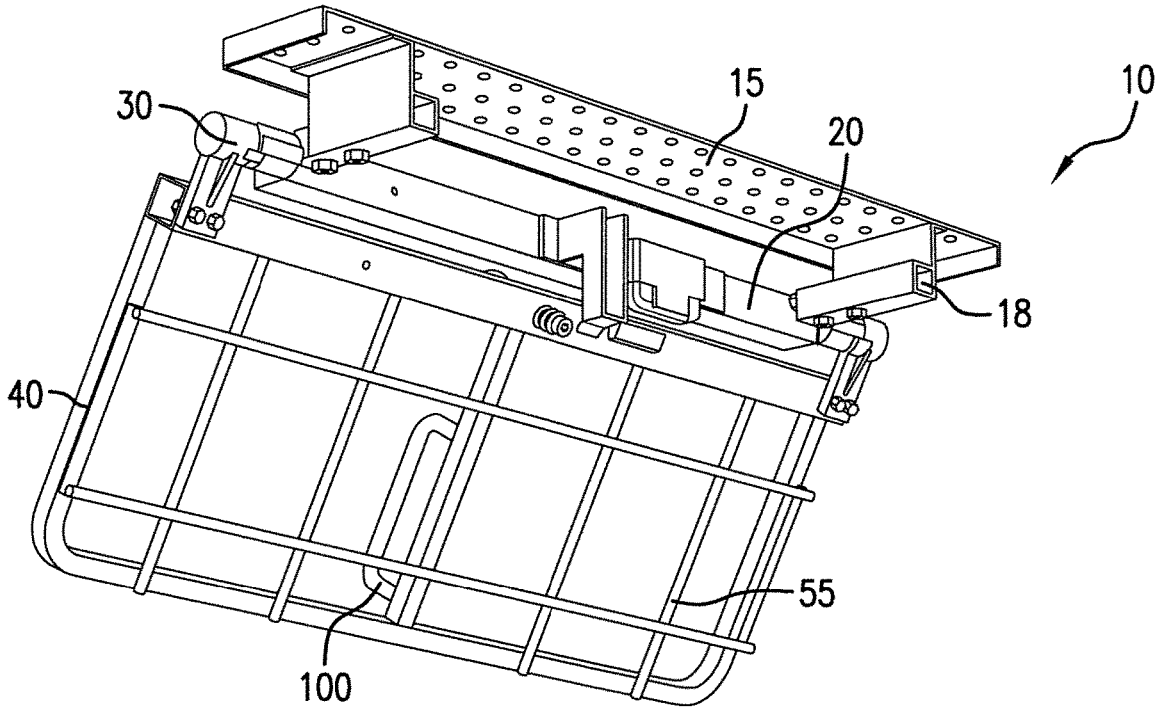
FIG. 17 is a rear perspective view of a mounting receiver and security gate in accordance with one aspect of the subject invention.

A guard 50 is preferably positioned across the rigid frame 40, as shown for example in FIGS. 5-7. The guard 50 prevents a user from removing the products from the shelf while in a latched position generally perpendicular to the shelf. The guard 50 may comprise a network of bars or wires sized appropriately to the product on the shelves that form a grate 55. The guard 50 is preferably mounted across an entirety of the rigid frame and may be sized according to the inventory positioned on the shelves. The grate 55 may comprise a small network of wire, similar to chickenwire, or may instead include a lattice of metal bars that are spaced apart so as to permit generally unencumbered visual access to the inventory on the shelves.

The guard 50 and the rigid frame 40 may be integrated into a single unit or may be welded or otherwise fixedly attached to each other to provide a secure enclosed space on the shelf the prevents products from being removed without unlatching the security gate 10 as described below. The guard 50 may be configured so as to permit a shopper to touch the product through the bars but not permit removal of the product without opening the security gate 10.

Figure 18:
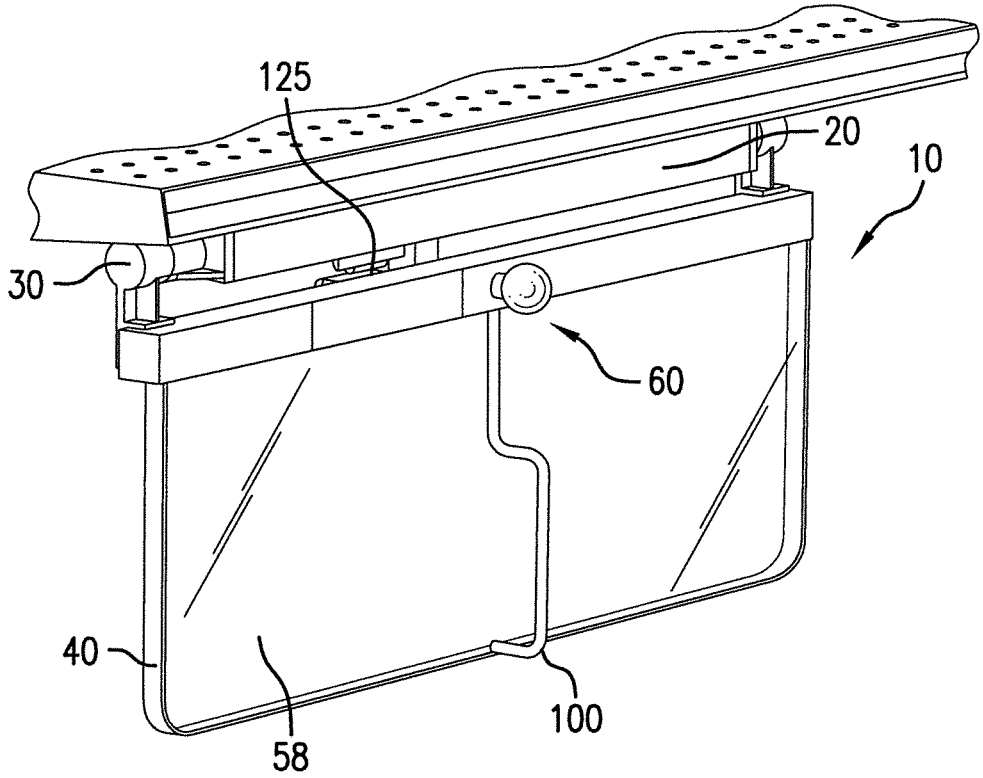
FIG. 18 is a front perspective view of a security gale in a closed position in accordance with one aspect of the subject invention.
Figure 19:
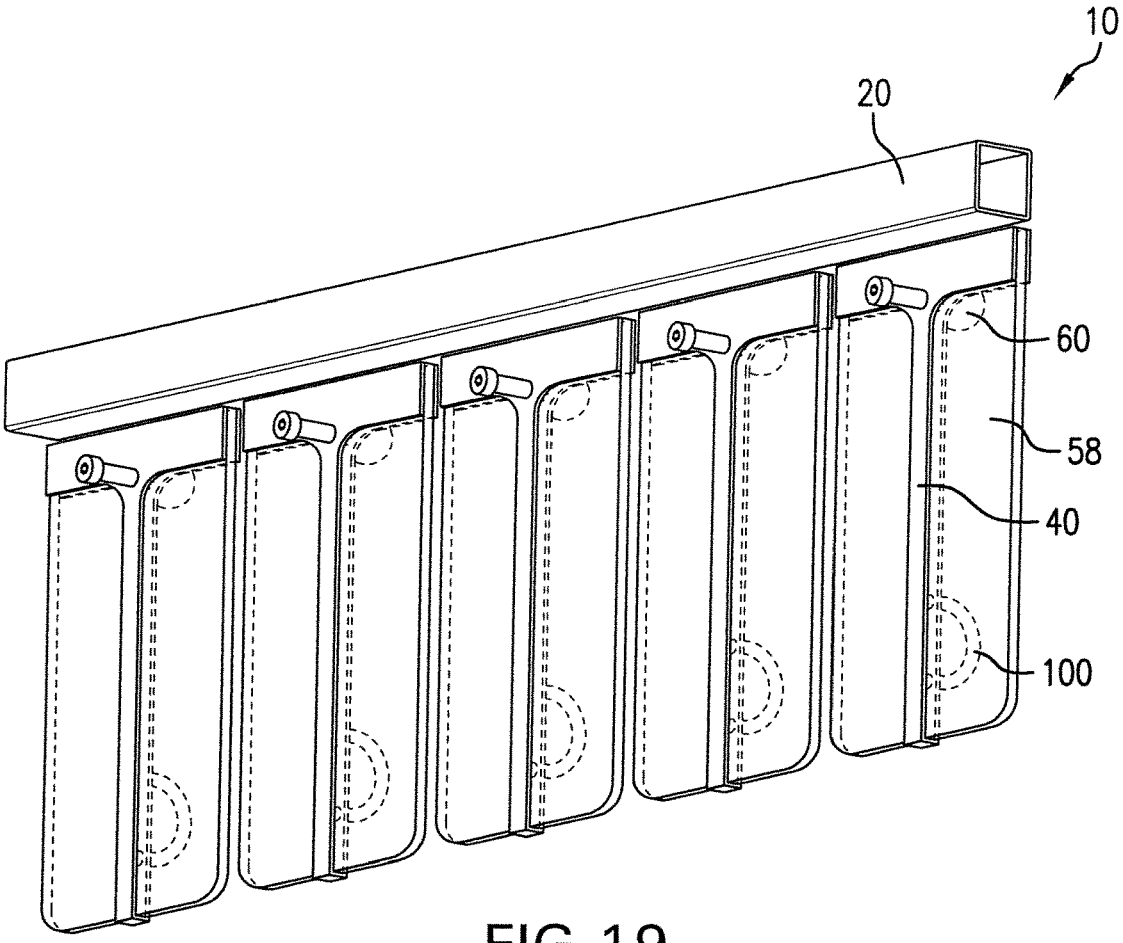
FIG. 19 is a front perspective view of a security gate in a closed position in accordance with one aspect of the subject invention.

According to one preferred embodiment, such as shown in FIGS. 18 and 19, the guard 50 may comprise a transparent shield, such as plexiglass 58, to permit a shopper to view the products but not permit access to the product without opening the security gate 10. This may be particularly applicable for smaller product or product that is desired for display without any visible obstructions.

As best shown in FIGS. 3, 4 and 8-12, the security gate 10 further includes a latching mechanism 60 connecting the rigid frame 40 to the header 20. The latching mechanism 60 in one preferred embodiment comprises a pin 65 having a knob 70 at an outer end. An engageable detent 75 is preferably located at an opposite end wherein a spring 80 is positioned between the knob 70 and the detent 75 to permit release of the latching mechanism 60. The detent 75 may be positioned on the header 20, as shown in the figures, and/or on the pin 65 of the latching mechanism 60. The pin 65 preferably thereby engages with the header 20 to prevent opening of the security gate 10 without releasing or otherwise influencing the latching mechanism 60.

In part because of the spring 80, the latching mechanism 60 is preferably biased to maintain a latching condition of the security gate 10. Only by positively releasing the latching mechanism 60 may a user raise the rigid frame 40 and guard 50 and gain access to the shelf.

The spring-loaded latching mechanism 60 preferably requires two handed operation to unlatch the latching mechanism as the rigid frame 40 is raised and opened relative to the shelf. In this manner, both hands are required to initiate the opening operation and, once the latch is disengaged, the customer can use that free hand to then hold and remove the inventory as the other hand is required to hold the security gate 10 open (without mechanical assistance).

Once the product is retrieved, the customer can release the security gate 10, and the rigid frame 40 and guard 50 preferably lowers back into position. Once lowered, the weight of the rigid frame 40 and guard 50 will preferably automatically reengage the latching mechanism 60 in a closed position.

According to one preferred embodiment, the security gate 10 may include a damper 90 connected with respect to the hinge 30 to permit at least one of a slowed closing or dampened opening of the rigid frame 40 relative to the header 20. It is preferable that the rigid frame 40 open with no or minimal damping and that, upon release, the rigid frame 40 slowly returns to the latched condition in a dampened manner to avoid slamming the security gate 10 shut and likewise avoid pinching or trapping of fingers and limbs within the device. The damper 90 may be integrated with the hinge 30 or may comprise a separate element positioned relative to the hinge 30, the rigid frame 40 and/or header 20.

As shown in the figures, a pull handle 100 is positioned on the security gate 10 and is separate and distinct from the latching mechanism 60. As shown, the pull handle 100 may be a metal loop or similar configuration that suggests to a user that it is to be pulled to open the security gate 10. By separating the pull handle 100 from the latching mechanism 60, a two-handed operation is required by a user to open the security gate 10 and access the shelf. In this manner, it is difficult for a user to also sweep a shelf or obtain unfettered access to the shelf while in the process of opening the security gate 10. It is preferably that the pull handle 100 is located toward or along a bottom edge of the rigid frame 40 while the latching mechanism 60 is located toward or along a top edge of the rigid frame 40 thereby creating physical separation between the two. As such, the pull handle 100 is located at an opposite edge of the guard as the latching mechanism 60.

The security gate 10 for a retail store shelf displaying one or more products is preferably retrofittable across a range of shelf styles and configurations. As shown in FIGS. 6 and 13-17 header 20 is preferably attached to the shelf using a mounting receiver 15 or bracket. Such mounting receivers or brackets are preferably an interchangeable and customizable component dependent on existing store shelving.

Figure 20:
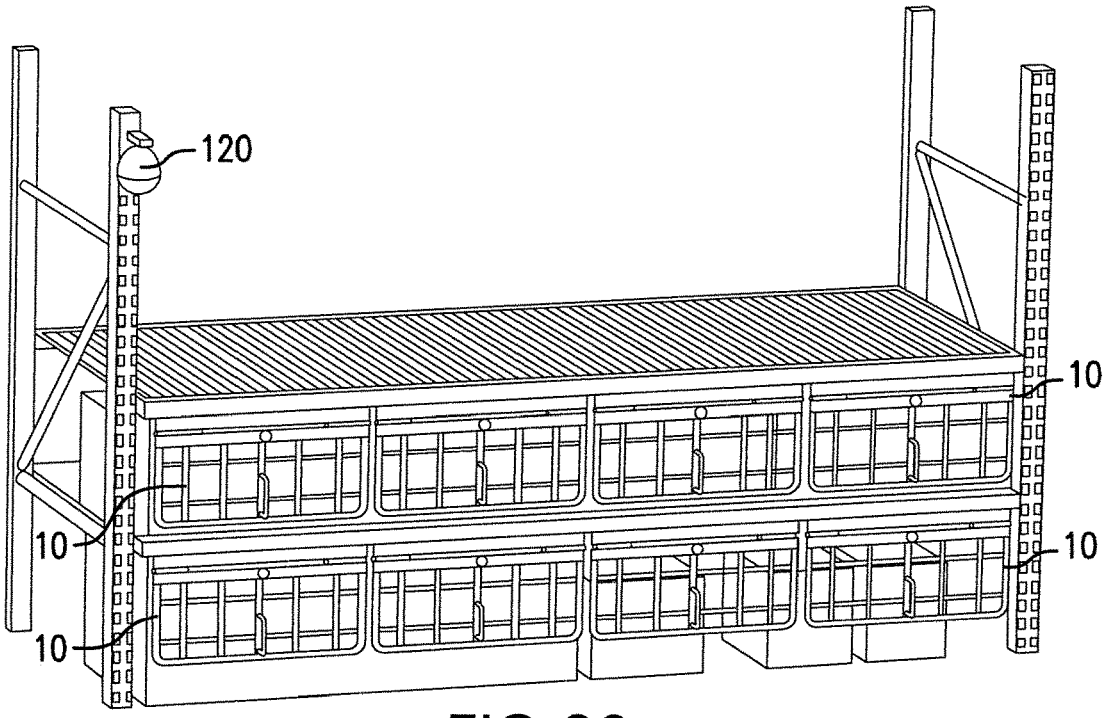
FIG. 20 is a front perspective view of a shelf fixture having a plurality of security gates in a closed position in accordance with one aspect of the subject invention.

The security gate 10 may include a rigid frame 10 for each header 20, such as shown in FIGS. 1-6, or may include a plurality of rigid frames 40 and latching mechanisms 60 on each header 20, such as shown in FIG. 19 connected. FIG. 20 shows an entire store shelving unit having multiple security gates 10 as contemplated by this invention. As shown in FIG. 20, the security gales 10 may be used on raised shelves or on the ground relative to a shelf above, thereby leveraging a store floor as an additional display surface while still maintaining security of the displayed product.

According to a preferred embodiment of this invention, an alarm 120 may sound when the security gate 10 is in an open position. The alarm 120 may comprise a visual light or strobe and/or an audible chime or noise that alerts area store personnel to the opening of the security gate 10, such as shown in FIG. 20. The alarm 120 may alternatively or in addition comprise a public address announcement throughout the store. In addition, store personnel may receive some indicator or message to an individual electronic device on their person. As shown in FIG. 7, sensors and/or contacts 125 may be positioned within the hinge 30 or between adjacent portions of the security gate 10 such as between the rigid frame 40 and the header 20 that trigger the alarm to be conveyed. Alternatively, contactless, wireless sensors or other types of sensors may be used to generate an alarm.

These sensors 125 may then transmit a condition to the alarm 120 to provide the notifications described above. The alarm 120 may therefore be activated when the sensor 125 determines that an alarming condition is met. The alarming condition may include at least one of: (1) release of the latching mechanism 60 one time; (2) release of the latching mechanism 60 X times, where X can be a reasonable number of unlatching actions as a sum total or a number of unlatching actions within a certain time; and/or (3) a time delta t between when the latching mechanism 60 is released and relatched. For instance, if a customer unlatches the latching mechanism 60 and does not release it for 60 seconds, a certain alarm 120 may be activated generally or directly to store personnel.

The above described alarm formats may change or escalate based upon alarming condition of the security gate 10. For instance, a format of the alarm may change from a blinking strobe to an audible alarm based on a number of security gates 10 that are open simultaneously in one shelving unit or throughout the store.

As described above, according to one preferred embodiment of this invention, an alarm and a visual strobe activates when a gate is open. In another preferred embodiment, when multiple (Z) gates are opened within a particular time period (t), then a second alarm sounds, preferably with a different sound, volume and/or message from the first alarm. For example, when one security gate 10 is opened, a doorbell chime may sound and the strobe may blink slowly. If three gates are opened within 15 seconds, an ambulance siren may sound and the strobe may blink faster, brighter and/or in a different color.

The security gate may be further connected with respect to an Ethernet and/or wireless connection within a retail environment to enable real time notification of store personnel when a single security gate is opened and/or opened X times and/or Z gates within a t time period. Such notifications may advise store personnel of the condition (Z gates) and/or the store location where the condition was observed.

In addition, an IoT enabled central control/computer processor may connects to a wireless receiver and captures gate open/close events and sensor status. The processor may store and send gate sensor activity and data to local or remote IP server endpoints. In addition, the processor may trigger local visual and audible alerts such as a strobe and chime. In addition, or alternatively, the processor may text alerts, email alerts, and other real time reporting based on gate events such as multiple security gates 10 opened quickly, security gates 10 left open, etc. Historic security gate 10 sensor 125 activity/status data may be stored in load and remote databases for post analytics processing and reporting.

In one preferred embodiment, each security gate 10 includes sensors 125 that each have a unique numeric ID which is sent to the central control/computer processor with each message/alert. These sensor IDs can be learned by the central processor to: filter out any ambient wireless data so we only act on our sensors; allow specific gate "plan-o-gram" identification to log which gate is open and where in the store (for larger installations); and/or allow other logic such as triggering events when a specific gate is left open too long or if multiple gates are all opened quickly. A store or central control may "learn" sensors to the system either by uploading a table of sensor IDs to the central control, or by activating a sensor (opening and closing a gate) several times within a short duration which will "auto learn" the sensor. This ensures that messages coming from nearby security systems that use the same kind of sensors will not become part of the central control system and cause false triggers. All data from these sensors can also be sent to a cloud server database and analytics can be reported on all the gate activity.

An audible and/or visual alert may be triggered locally when gates are opened, but this behavior may be programmable. For example, a doorbell chime sound may be triggered when a gate is open, but if 3 gates are opened within 15 seconds, a different siren sound may be triggered, such as described above. The sounds may be customizable using .WAV files over a pair of standard USB powered speakers. These sounds could also be voice prompts and/or public address announcements such as "customer needs assistance in the tool aisle," etc. A chime or other sound may be triggered if a security gate has been left opened for more than a predetermined time period t, for instance 80 minutes. This "left open" alert may be a third alarm different from the first alarm and/or the second alarm.

A related method for theft prevention from a retail store shelf including a security gate 10 includes providing a header 20 along a top of the shelf; providing at least one hinge 30 arranged along the header 20; providing a rigid frame 40 on the header 20 with the at least one hinge 30; positioning a guard 50 across the rigid frame, the guard 50 preventing a user from removing the products; and providing a latching mechanism connecting the rigid frame to the header 20. It is preferable in such a method that the security gate 10 requires two hands to open, one hand to release the latching mechanism and the other to pull the rigid frame open relative to the header.

While in the foregoing detailed description the subject development has been described in relation to certain preferred embodiments thereof, and many details have been set forth for purposes of illustration, it will be apparent to those skilled in the art that the subject development is susceptible to additional embodiments and that certain of the details described herein can be varied considerably without departing from the basic principles of the invention.

We claim:

1. A security gate for a retail store shelf having one or more products, the security gate comprising:

a header;

at least one hinge arranged in a horizontal alignment with the header;

a rigid frame connected to the header with the at least one hinge;

a guard positioned across the rigid frame, the guard preventing a user from removing the products; and a latching mechanism connecting the rigid frame to the header, wherein the latching mechanism comprises a pin having a knob at an outer end and an engageable detent at an inner end wherein a spring is positioned between the knob and the detent to permit release of the latching mechanism.

2. The security gate of claim 1 wherein the guard comprises a grate.

3. The security gate of claim 1 wherein the guard comprises a transparent shield.

4. The security gate of claim 1 further comprising a sensor connected with respect to an alarm.

5. The security gate of claim 4 wherein the alarm is activated when the sensor determines that an alarming condition is met.

6. The security gate of claim 5 wherein the alarming condition is at least one of: release of the latching mechanism one time; release of the latching mechanism X times; and a time delta t between when the latching mechanism is released and relatched.

7. The security gate of claim 4 wherein the alarm is at least one of a strobe; an audible alarm; an alert directed to a personal electronic device; and a public address announcement.

8. The security gate of claim 7 wherein a format of the alarm changes based on an alarming condition of the security gate.

9. The security gate of claim 7 wherein a format of the alarm changes based on a number of security gates that are open simultaneously.

10. The security gate of claim 1 further comprising a central processor that collects security gate open/close events and sensor status for one or more security gates throughout a retail store.

11. The security gate of claim 10 further comprising a unique ID assigned to each security gate to identify and analyze separate plan-o-grams of retail store space.

12. The security gate of claim 1 further comprising a damper connected with respect to the hinge to permit at least one of a slowed closing or dampened opening of the rigid frame relative to the header.

13. The security gate of claim 1 further comprising a pull handle distinct from the latching mechanism.

14. The security gate of claim 13 wherein the pull handle is located at an opposite edge of the guard as the latching mechanism.

15. The security gate of claim 1 wherein for each header, a plurality of rigid frames and latching mechanism are connected.

16. The security gate of claim 1 wherein the latching mechanism is configured to require a user to use two hands to open the security gate, one hand on the latching mechanism and the other hand to pull the rigid frame and/or the guard upward relative to the shelf.

17. A method for theft prevention from a retail store shelf including a security gate, the method comprising:

providing a header along a top of the shelf;

providing at least one hinge arranged along the header;

providing a rigid frame on the header with the at least one hinge;

positioning a guard across the rigid frame, the guard preventing a user from removing the products; and providing a latching mechanism connecting the rigid frame to the header, wherein the latching mechanism comprises a pin having a knob at an outer end and an engageable detent at an inner end wherein a spring is positioned between the knob and the detent to permit release of the latching mechanism.

18. The method of claim 17 wherein the security gate requires two hands to open, one hand to release the latching mechanism and the other to pull the rigid frame open relative to the header.

19. A security gate for a retail store shelf having one or more products, the security gate comprising:

a header;

at least one hinge arranged in a horizontal alignment with the header;

a rigid frame connected to the header with the at least one hinge;

a guard positioned across the rigid frame, the guard preventing a user from removing the products;

a latching mechanism connecting the rigid frame to the header, wherein the latching mechanism comprises a pin having a knob at an outer end and wherein an engageable detent engages an inner end of the pin and a spring is positioned between the knob and the detent to permit release of the latching mechanism, and wherein the latching mechanism is configured to require a user to use two hands to open the security gate, one hand on the latching mechanism and the other hand to pull the rigid frame and/or the guard upward relative to the shelf;

a sensor positioned on at least one of the rigid frame and the header and further connected with respect to an alarm, wherein the alarm is activated when the sensor determines that an alarming condition is met.

* * * * *